US007640905B2

(12) United States Patent
Nonogaki

(10) Patent No.: US 7,640,905 B2
(45) Date of Patent: Jan. 5, 2010

(54) ENGINE COVER MOUNTING STRUCTURE

(75) Inventor: Haruhiko Nonogaki, Aichi (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 241 days.

(21) Appl. No.: 11/313,943

(22) Filed: Dec. 22, 2005

(65) Prior Publication Data

US 2006/0157015 A1 Jul. 20, 2006

(30) Foreign Application Priority Data

Dec. 28, 2004 (JP) ..... P2004-381936

(51) Int. Cl.
*F01M 9/10* (2006.01)

(52) U.S. Cl. ..... 123/90.37; 123/90.38

(58) Field of Classification Search ..... 123/90.37, 123/90.38, 198 E; 277/593, 598, 640, 916; 156/272.6; 29/888.01; 427/535
See application file for complete search history.

(56) References Cited

U.S. PATENT DOCUMENTS 4,867,461 A * 9/1989 Shimmell ..... 277/593
5,513,603 A * 5/1996 Ang et al. ..... 123/90.37
5,580,204 A 12/1996 Hultman
5,957,100 A * 9/1999 Frohwerk et al. ..... 123/90.38
7,305,962 B2 * 12/2007 Nonogaki et al. ..... 123/195 C
2004/0170469 A1 9/2004 Ochiai et al. ..... 403/122
2004/0187838 A1 9/2004 Nonogaki et al.

FOREIGN PATENT DOCUMENTS

JP A-2004-316637 11/2004

OTHER PUBLICATIONS

Office Action dated Aug. 12, 2009 issued from the Japan Patent Office for corresponding patent application No. 2004-381936 (English translation enclosed).

* cited by examiner

*Primary Examiner*—Stephen K Cronin
*Assistant Examiner*—Keith Coleman
(74) *Attorney, Agent, or Firm*—Posz Law Group, PLC

(57) ABSTRACT

In an engine cover mounting structure, an internal portion of an elastic member comprises a small diameter hole portion having a small inside diameter and a large diameter hole portion having a large inside diameter which continues to the small diameter hole portion, the relationship between an outside diameter W1 of a head portion which engages with the elastic member and an inside diameter W2 of the small diameter hole portion is set to be W1>W2, and the relationship between an inside diameter W3 of the large diameter hole portion and an outside diameter W4 of a leg portion is set to be W3≧W4, the large diameter hole portion and the small diameter hole portion are made to communicate with each other in a step-like fashion, and at least part of a portion to be restrained is provided on an outer circumferential side of the large diameter hole portion.

12 Claims, 6 Drawing Sheets

ENGINE COVER MOUNTING STRUCTURE

This application is based on Japanese Patent Application No. 2004-381936, which is incorporated herein by reference.

BACKGROUND OF THE INVENTION

1. Field of the Invention

The present invention relates to an engine cover mounting structure of an engine and an engine cover which covers the engine.

2. Description of the Related Art

It has become common in recent years that an engine cover is provided at a position between an engine and a bonnet in an engine compartment of a vehicle. This engine cover has a function to enhance the design property within the engine compartment by visually shielding the engine as well as a function to block noise that leaks (or is transmitted) from the engine.

The engine cover is mounted on an engine member. There are known various methods of mounting an engine cover on an engine member. For example, there exists a method of fastening an engine cover and an engine member together with bolts. In addition, there exists a method in which mounting portions are provided on one of a rear side of an engine cover and an upper surface of an engine member and portions to be mounted are provided on the other, whereby the engine cover is mounted on the engine member by bringing the mounting portions and the portions to be mounted into engagement with each other (for example, refer to JP-A-2004-278779).

In a engine cover mounting structure disclosed in JP-A-2004-278779, a mounting portion is made up of a hollow frame portion and a hollow elastic member which is inserted into the frame portion. A projection having a shape corresponding to a hollow interior of the elastic member is used as a portion to be mounted. Then, the mounting portion and the portion to be mounted are attached to each other by inserting the projection into the hollow interior of the elastic member. Since the elastic member is inserted in the frame portion, the portion to be mounted is mounted in the frame portion via the elastic member.

The frame portion is opened at a distal end thereof, that is, an end portion of the frame portion which is to face the portion to be mounted is opened. The elastic member inserted in the frame portion is formed into a cylindrical shape which is opened at two end portions thereof; an end portion facing the portion to be mounted and an opposite end portion thereto. Due to this, the projection is inserted into the elastic member through the opening in the frame portion. A restraining portion is provided on the frame portion in such a manner as to project into the hollow interior. A portion to be retrained is provided on an outer circumferential side of the elastic member at a position corresponding to the restraining portion in such a manner as to be brought into engagement with the restraining portion. The elastic member is held in the frame portion by virtue of the engagement of the restraining portion with the portion to be restrained. A cylindrical interior defined in the elastic member is formed into a shape which is expanded and contracted in an axial direction. An external shape of the projection is formed into a shape which corresponds to the cylindrical interior of the elastic member. Due to this, when the projection is inserted and passed through the elastic member, an internal surface of the elastic member and an external surface of the projection are brought into engagement with each other, whereby the portion to be mounted is mounted in the mounting portion.

The projection is formed into a shape which is diametrically expanded at an axially distal end and diametrically contracted at a central portion thereof. The internal surface of the elastic member is formed into a shape in which a diametrically expanded portion and a diametrically contracted portion are provided in an axial direction thereof in order to conform to the shape of the projection. Due to this, when the distal end (the diametrically expanded portion) of the projection is passed along the diametrically contracted portion of the elastic member in an attempt to insert the projection into the elastic member, the projection needs to be inserted while diametrically expanding the elastic member, and this increases a load (a press fit load) required for the insertion. Then, when the distal end of the projection has passed through the diametrically contracted portion of the elastic member, the press fit load is reduced. As this occurs, the elastic member elastically deforms to be contracted after the temporary expansion, and since the elastic member comes into spring contact with the projection when so contracted, a vibration of shock produced when the elastic member comes into spring contact with the projection is transmitted to the hand of the operator. Consequently, the operator is able to sense and realize through a change in press fit load and the vibration whether or not the mounting work has been completed. A touch perception imparted or sensed by the operator as this occurs is referred to as a click stop feeling in insertion in this specification.

Here, in an engine cover mounting structure like the one disclosed in Patent JP-A-2004-278779, the external shape of the projection is formed into a shape which corresponds to the cylindrical interior of the elastic member. Then, in order to ensure the fixing of the projection to the elastic member, the external shape of the projection is made larger than the cylindrical interior of the elastic member. Due to this, since the projection is inserted while being brought into press contact with the elastic member, the load (the press fit load) produced when the projection is inserted into the elastic member is increased, deteriorating the mounting work efficiency. The press fit load can be reduced by reducing a dimensional difference between an inside diameter of the elastic member and an outside diameter of the projection. In this case, however, the aforesaid click stop feeling in insertion is deteriorated, and this makes it difficult for the operator to sense and realize whether or not the mounting work has been completed. Consequently, also in this case, there has been caused a problem that the mounting work efficiency is not improved as desired.

SUMMARY OF THE INVENTION

The invention was made in view of the situations, and an object thereof is to provide an engine cover mounting structure which can attain the efficient mounting of an engine cover on an engine member.

With a view to solving the problem, according to the invention, there is provided an engine cover mounting structure comprising an engine member having a mounting portion, and an engine cover having a cover main body and a portion to be mounted which extends from the cover main body, wherein one of the mounting portion and the portion to be mounted has a leg portion and a head portion which is formed at a distal end of the leg portion in such a manner as to have a larger diameter than a diameter of the leg portion, wherein the other of the mounting portion and the portion to be mounted has a frame portion which is formed into a hollow shape having an end opening at a distal end thereof and which has a restraining portion which projects into a hollow of the hollow shape and an elastic member which is inserted in the frame portion, wherein the elastic member is formed substantially into a cylindrical shape having a large diameter hole portion which opens towards the end opening, a small diameter hole portion which extends to communicate with the large diameter hole portion at one end and open at the other end thereof which is opposite end to the end opening and has a smaller inside diameter than an inside diameter of the large diameter hole portion, and a portion to be restrained which is formed on an outer circumferential surface of the elastic member so as to be brought into engagement with the restraining portion, wherein the portion to be mounted is mounted on the mounting portion in such a manner that the head portion is inserted from the large diameter hole portion towards the small diameter hole portion so as to project out of the small diameter hole portion, wherein a relationship between an outside diameter W1 of the head portion and the inside diameter W2 of the small diameter hole portion is expressed as W1>W2, and a relationship between the inside diameter W3 of the large diameter hole portion and an outside diameter W4 of the leg portion is expressed as W3≧W4, wherein the large diameter hole portion and the small diameter hole portion communicate with each other in a step-like fashion, and wherein at least part of the portion to be restrained lies on an outer circumferential side of the large diameter hole portion.

In the engine cover mounting structure of the invention, an axial length of the small diameter hole portion is preferably shorter than an axial length of the large diameter hole portion.

In the engine cover mounting structure of the invention, the portion to be restrained preferably lies adjacent to the small diameter hole portion with respect to an axial positional relationship.

In the engine cover mounting structure of the invention, the whole of the portion to be restrained is preferably provided on the outer circumferential side of the large diameter hole portion.

Further, there is also provided an engine cover mounting structure comprising an engine member having a mounting portion, and an engine cover having a portion to be mounted, wherein the mounting portion comprises a frame portion and an elastic member which is inserted in the frame portion, wherein the portion to be mounted comprises a leg portion and a head portion which is formed at a distal end of the leg portion in such a manner as to have a larger diameter than a diameter of the leg portion, wherein the elastic member comprises a large diameter hole portion which opens toward the portion to be mounted side of the elastic member, and a small diameter hole portion which opens to another side of the elastic member, opposite to the portion to be mounted side thereof, and has a smaller inside diameter than an inside diameter of the large diameter hole portion, wherein the portion to be mounted is mounted on the mounting portion in such a manner that the head portion is inserted from the large diameter hole portion towards the small diameter hole portion so as to project out of the small diameter hole portion, wherein a relationship between an outside diameter W1 of the head portion and the inside diameter W2 of the small diameter hole portion is expressed as W1>W2, and a relationship between the inside diameter W3 of the large diameter hole portion and an outside diameter W4 of the leg portion is expressed as W3≧W4, and wherein the large diameter hole portion and the small diameter hole portion communicate with each other.

In the engine cover mounting structure of the invention, the leg portion and the head portion are provided one of the mounting portion and the portion to be mounted and the small diameter hole portion and the large diameter hole portion are provided on the other. Then, the relationship between the outside diameter W1 of the head portion and the inside diameter W2 of the small diameter hole portion is W1>W2, and the relationship between the inside diameter W3 of the large diameter hole portion and the outside diameter W4 of the leg portion is W3≧W4. Note that since the head portion is diametrically larger than the leg portion, the relationship between the outside diameter W1 and the outside diameter W4 of the leg portion is W1>W4. In addition, since the inside diameter of the large diameter hole portion is larger than that of the small diameter hole portion, the relationship between the inside diameter W2 of the small diameter hole portion and the inside diameter W3 of the large diameter hole portion is W2<W3.

In the engine cover mounting structure of the invention, when the portion to be mounted is mounted on the mounting portion, the head portion is inserted into the elastic member from the large diameter hole portion to the small diameter hole portion in that order, is then passed through the small diameter hole portion and is eventually projected out the small diameter hole portion.

Here, since the relationship between the outside diameter W1 of the head portion and the inside diameter W2 of the small diameter hole portion is W1>W2, the press fit load resulting when the heat portion is inserted into the small diameter hole portion with the leg portion inserted into the large diameter portion (a middle stage of insertion) is large. On the other hand, the relationship between the inside diameter W2 of the small diameter hole portion and the inside diameter of the large diameter hole portion is W2<W3 and the relationship between the inside diameter W3 of the large diameter hole portion and the out side diameter W4 of the leg portion is W3≧W4, a press fit load resulting when the head portion is inserted in the large diameter hole portion (an initial state of insertion) and a press fit load resulting when the head portion passes through the small diameter hole portion with the leg portion inserted in the large diameter hole portion and the small diameter hole portion (a last state of insertion) are smaller than the press fit load at the middle state of insertion. Consequently, the press fit load produced during a mounting operation changes in the order of small→large→small, thereby making it possible to obtain a superior click stop feeling in insertion. Due to this, the portion to be mounted can easily be mounted on the mounting portion, the mounting work efficiency being thereby increased largely.

In addition, since the outside diameter W4 of the leg portion and the inside diameter W3 of the large diameter hole portion is W3≧W4, the leg portion and the large diameter hole portion are not brought into press contact with each other, and hence, the press fit load can remain small by that extent. Note that in the event that the relationship between the outside diameter W4 of the leg portion and the inside diameter W2 of the small diameter hole portion is made to be W2<W4, the leg portion can be mounted in the small diameter hole portion without any looseness.

The inside diameter W2 of the small diameter hole portion is larger than the outside diameter W1 of the head portion and is also larger than the outside diameter W4 of the leg portion. Due to this, the small diameter hole portion is diametrically expanded temporarily when the head portion passes therethrough and elastically deforms to be restored to the inside diameter which corresponds to the outside diameter W4 of the leg portion once the head portion has passed through the small diameter hole portion. Consequently, the head portion, which has passed through the small diameter hole portion, is made difficult to be reversed and hence becomes difficult to be dislodged therefrom.

Furthermore, since the large diameter hole portion and the small diameter hole portion communicate with each other in a step-like fashion, when the head portion has passed through the large diameter hole portion to reach the small diameter hole portion, the press fit load increases largely in a small displacement. Furthermore, the press fit load decreases drastically from around a point in time where the head portion is inserted to lie near a middle portion of the small diameter hole portion. Thus, since the press fit load increases drastically and thereafter decreases drastically, a better click stop feeling in insertion can be obtained.

Then, by providing at least part of the portion to be restrained on the outer circumferential side of the large diameter hole portion, the mounting operation of the engine cover on to the engine member can be facilitated. Namely, the portion to be restrained is a portion that is brought into engagement with the restraining portion, and an inner circumferential side of the portion to be restrained is a portion of the elastic member that is difficult to be deformed. By providing at least part of the portion to be restrained on the outer circumferential side of the large diameter hole portion where displacement is small, the small diameter hole portion where displacement is large can be made to be deformed sufficiently without requiring any excessive load. Due to this, an excessive press fit load is not required when the head portion passes through the small diameter hole portion, whereby the engine cover can easily be mounted on the engine member. Furthermore, a distance along which the portion to be restrained overlaps the small diameter hole portion can be reduced, whereby the extent of an area on the elastic member which requires an excessive press fit load at the time of mounting can be suppressed to a small value, this facilitating the mounting operation.

In the engine cover mounting structure of the invention, by combinations of these functions, an extremely superior click stop feeling in insertion can be exhibited and hence, the mounting work can be facilitated. Consequently, in the engine cover mounting structure of the invention, the engine cover can be mounted on the engine member with good efficiency.

In addition, in the engine cover mounting structure of the invention, in the event that the axial length of the small diameter hole portion is set to be smaller than the axial length of the large diameter hole portion, the displacement of the head portion when passing through the small diameter hole portion becomes small, and the press fit load increases more drastically. Due to this, there is provided an advantage that a more superior click stop feeling in insertion can be obtained.

In the event that the whole of the portion to be restrained is provided on the outer circumferential side of the large diameter hole portion, it is possible in a further ensured fashion to avoid a risk that the press fit load becomes too large when the head portion passes through the small diameter hole portion, thereby making it possible to increase the mounting work efficiency further.

DETAILED DESCRIPTION OF THE PREFERRED EMBODMENTS

Figure 1:
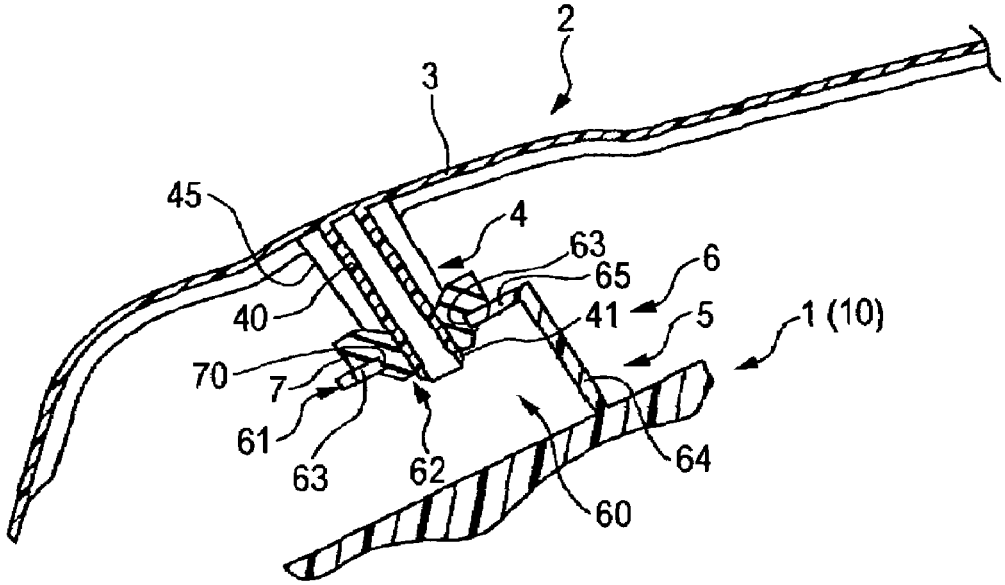
FIG. 1 is a sectional view which exemplarily shows an engine cover mounting structure of Embodiment 1.

An engine cover mounting structure of the invention includes an engine member and an engine cover. Then, the engine cover is held on the engine member. While it is a common practice that the engine cover is held above the engine member so as to cover an upper portion of the engine member, depending upon designs of engine compartments, the engine cover may cover other portions (for example, a side portion) than the upper portion of the engine member. The engine cover according to the invention may be such as to cover only part of the engine member or may be such as to cover the whole of the engine member.

The engine member is a general designation for an engine main body constituted by cylinders and pistons, a cylinder cover which covers a cylinder head on the engine main body, fuel and air supply systems for supplying fuel and air for the engine main body, a cam systems for controlling the intake of air/fuel and discharge of exhaust gas, an oil circulating system and the like. The engine cover of the invention is to be held at any portion of the engine member.

In the engine cover mounting structure of the invention, the engine member has a mounting portion, and the engine cover has a cover unit and a portion to be mounted, or inserting portion, which extends from the cover unit. One of the portion to be mounted and the mounting portion has a leg portion and a head portion and the other has a frame portion and an elastic member. The elastic member is inserted into the frame portion and is also brought into engagement with the frame portion. The mounting portion is inserted into the elastic member and the head portion extends further forwards than a distal end of a small diameter hole portion of the elastic member to thereby emerge from the small diameter hole portion. Namely, the head portion is mounted on the frame portion via the elastic member. Consequently, the engine cover mounting structure of the invention is more advantageous than a related engine cover mounting structure in which an engine cover is screw fastened to an engine member via bolts in that the engine cover can be mounted on the engine member more easily than by the related method.

The numbers of mounting portions and portions to be mounted may any numbers as long as they correspond to each other. The engine cover is fixed to the engine cover more strongly as the numbers of mounting portions and portions to be mounted increase, the engine cover mounting work gets easier as the number of mounting portions and portions to be mounted decrease. Respective mounting portions may be formed into the same shape or into different shapes. This is true with the portions to be mounted.

The mounting portion may be formed into any shape as long as the mounting portion can reach a position where the portion to be mounted is so mounted, and among the aforesaid engine members, the mounting portion may be provided, for example, on an upper surface of the cylinder head cover or may be provided on a side thereof. Alternatively, the mounting portion may be provided on any other aforesaid engine members than the cylinder head cover.

The elastic member can be used from any members made of elastic materials such as rubber, elastomer and the like. In the event that EPDM, CR, NR, TPO and the like are used from such a variety, there can be provided an advantage that the engine cover can be fixed to the engine member strongly and rigidly.

Furthermore, in the engine cover mounting structure of the invention, in the event that the relationship between the outside diameter W1 of the head portion and the inside diameter W3 of a large diameter hole portion is W1<W3, since the portion to be mounted is inserted into the mounting portion in such a state that the head portion is not in abutment with the large diameter hole portion, a press fit load at an initial stage of insertion is low, and the operator can confirm through touch perception whether or not an inserting operation has been initiated in an ensured fashion when the head portion has reached the small diameter hole portion. By virtue of this, there can be provided an advantage that the mounting work efficiency can further be enhanced.

Embodiments of engine cover mounting structures of the invention will be described below based on the accompanying drawings.

Embodiment 1

Figure 2:
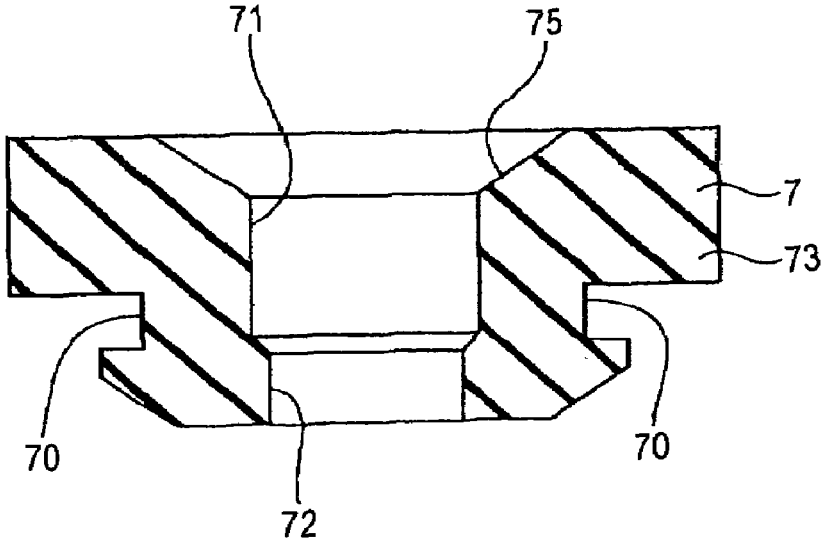
FIG. 2 is a sectional view which exemplarily shows an elastic member of the engine cover mounting structure of Embodiment 1.
Figure 3:
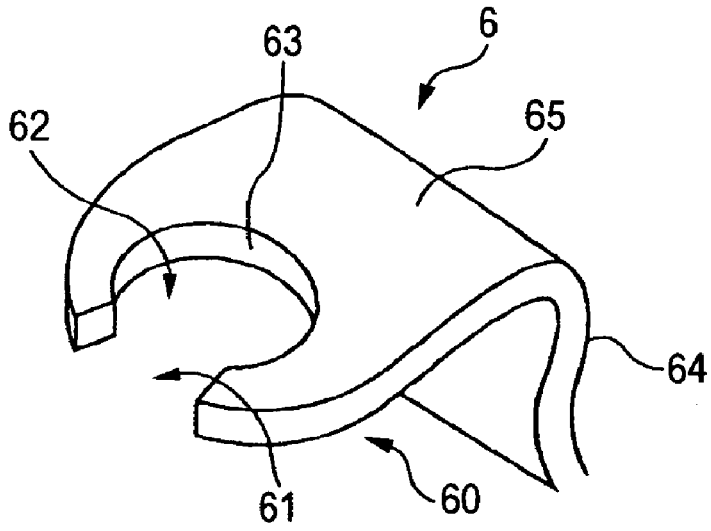
FIG. 3 is a perspective view which exemplarily shows a frame portion of the engine cover mounting structure of Embodiment 1.

An engine cover mounting structure of an embodiment or Embodiment 1 of the invention is such that a portion to be mounted has a leg portion and a head, and a mounting portion has a frame portion and an elastic member. FIG. 1 is a sectional view which exemplarily shows an engine cover mounting structure of the embodiment, and FIG. 2 is a sectional view which exemplarily shows an elastic member of the engine cover mounting structure. In addition, FIG. 3 is a perspective view which exemplarily shows a frame portion.

The engine cover mounting structure of the embodiment has an engine member 1 and an engine cover 2. The engine cover 2 has a cover unit 3 and portions to be mounted 4, or inserting portions. The cover unit3 is formed into the shape of a sheet. The portions to be mounted 4 are provided on the cover unit 3 in such a manner as to extend downwards therefrom. Each portion to be mounted 4 has a leg portion 40 which connects to the cover unit 3 and a head portion 41 which is formed at a distal end of the leg portion 40. The head portion 41 is formed diametrically larger than the leg portion 40. The leg portion 40 and the head portion 41 are both formed hollow. Furthermore, ribs 45 are provided on the leg portion 40 at a portion closer to the cover unit 3 in such a manner as to project radially outwardly from an outer circumferential surface of the leg 40. An end portion of the rib 45 which lies to face the head portion 41 constitutes a stopper when the portion to be mounted 4 is press fitted into an elastic member, which will be described later on.

Mounting portions 5 are provided on a cylinder head cover 10 of the engine member 1 in such a manner as to extend upwardly therefrom. The mounting portion 5 is made up of a hollow frame portion 6 and an elastic member 7 which is formed into a short cylindrical shape. The elastic member 7 is inserted in the frame portion 6.

The frame portion 6 is made up of a base portion 64 which is provided on an upper surface of the cylinder head cover 10 in such a manner as to extend upwardly therefrom and a holding portion 65 which is formed at a distal end of the base portion 64 in such a manner as to be bent in a direction which intersects with a direction in which the base portion 64 extends. An end opening 62 is provided substantially at a central portion of the holding portion 65 in the form of a through hole. An outer edge of this end opening 62 constitutes a restraining portion 63. The end opening 62 communicates with a guide hole 61 which is opened at an end of the holding portion 65. An internal hollow 60 is defined below the end opening 62.

A groove-shaped portion to be restrained 70, or engagement portion, is formed on an outer circumferential surface of the elastic member 7 in such a manner as to extend circumferentially. This portion to be restrained 70 is brought into engagement with the restraining portion 63. The elastic member 7 inserted in the frame portion 6 is mounted on the frame portion 6 through engagement of the portion to be restrained 70 with the restraining portion 63.

One section of an interior of the elastic member 7 , which lies within the end opening 62, has a relatively large diameter, and an adjacent section of the elastic member 7, which lies below the end opening 62 in the hollow 60, has a relatively small diameter. The portion formed into the large diameter constitutes a large diameter hole portion 71, and the portion formed into the small diameter constitutes a small diameter hole portion 72. The large diameter hole portion 71 and the small diameter hole portion 72 are coaxial and communicate with each other in a step-like fashion. The axial length of the small diameter hole portion 72 is shorter than the axial length of the large diameter hole portion 71. Hereinafter, the portion of the elastic member 7 where the large diameter hole portion 71 is formed is referred to as a non-tightening portion 73, whereas the portion where the small diameter hole portion 72 is formed is referred to as a tightening portion 74. The elastic member 7 is made up of the tightening portion 74 and the non-tightening portion 73.

A mortar-shaped positioning end 75 is formed at an upper end of the non-tightening portion 73 of the elastic member 7 where the large diameter hole portion 71 is gradually diametrically expanded as it extends upwardly. The positioning end 75 is a portion where the engine cover 2 and the cylinder head cover 10 are positioned relative to each other.

In the engine cover 2 mounting structure of the embodiment, the portion to be restrained 70 is formed on an outer circumferential side of the large diameter hole portion 71 of the elastic member 7. In other words, the portion to be restrained 70 is formed on the non-tightening portion 73 of the elastic member 7. When the elastic member 7 is mounted on the frame portion 6, the elastic member is press fitted into the end opening 62 from the guide hole 61 while the portion to be restrained 70 is being in abutment with the outer edge of the guide hole 61. As this occurs, the portion to be restrained 70 is brought into engagement with the restraining portion 63 in such a state that a portion of the elastic member 70 which lies further lower than the portion to be restrained 70 (mainly the tightening portion 74) is inserted into the hollow interior 60 of the frame portion 6, while a portion which lies further upper than the portion to be restrained 70 (mainly the non-tightening portion 73) is exposed from the end opening 62 of the frame portion 6, whereby the elastic member 7 is held on the frame portion 6.

Figure 4:
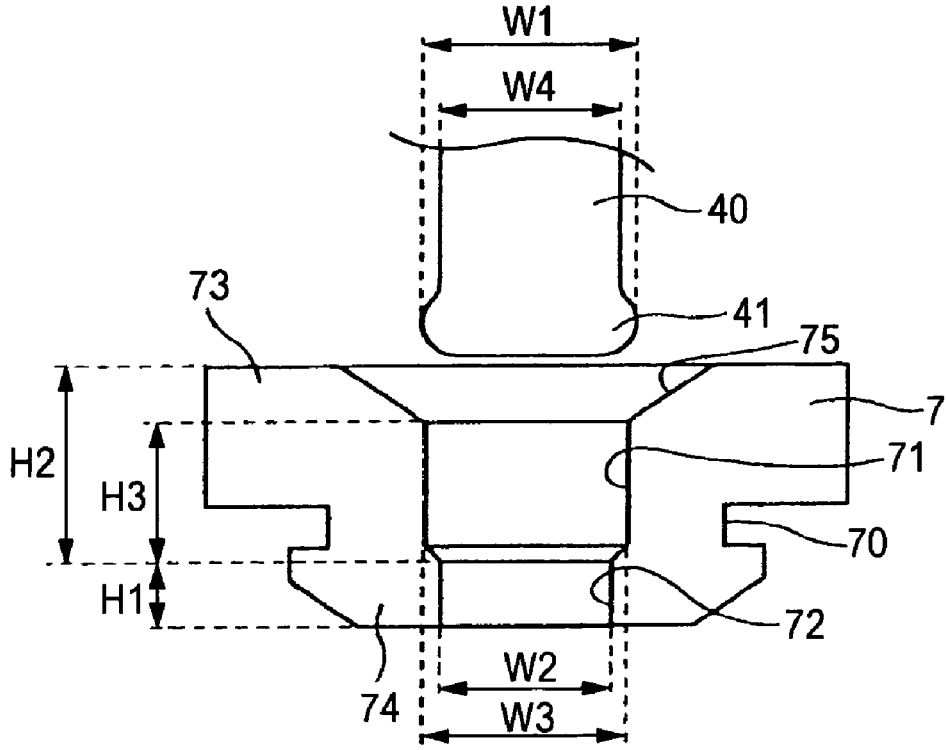
FIG. 4 is an explanatory drawing which shows measuring positions where dimensions of respective portions of the engine cover mounting structure of Embodiment 1 are measure.

In the engine cover mounting structure of the embodiment, an outside diameter W1 of the head portion is 12.5 mm, an inside diameter W2 of the small diameter hole portion 72 is 10 mm, an inside diameter W3 of the large diameter hole portion is 13 mm, and an outside diameter W4 of the leg portion 40 is 12 mm. Furthermore, an axial length H1 of the tightening portion 74 (the axial length of the small diameter hole portion 72) is 5 mm, and an axial length H2 of the non-tightening portion 73 (the axial length of the large diameter hole portion 71) is 14 mm. An axial length H3 of the non-tightening portion 73 excluding the positioning end 75 is 9 mm. For reference, measuring positions of dimensions of the respective portions are shown in FIG. 4. The outside diameter W1 of the head portion 41 takes a value measured at the portion where a largest outside diameter is produced on the head portion 41. The inside diameter W2 of the small diameter hole portion 72 takes a value measured at the portion where a smallest inside diameter is produced on the small diameter hole portion 72. The inside diameter W3 of the large diameter hole portion 71 takes a value measured at the portion where a largest inside diameter is produced on the large diameter hole portion 72 excluding the positioning end 75. The outside diameter W4 of the leg portion 40 is a value measured at the portion where a smallest outside diameter is produced on the leg portion 40.

In the engine cover mounting structure of the embodiment, when mounting the engine cover 2 on the cylinder head cover 10, firstly, the head portion 41 of the portion to be mounted 4 is brought into abutment with the upper end of the non-tightening portion 73 of the elastic member 7, and a positioning is implemented between the portion to be mounted 4 and the mounting portion 5. Here, the positioning end 75 is formed at the upper end of the non-tightening portion of the elastic member 73. By virtue of this, the positioning between the head portion 41 and the elastic member 7 is implemented with ease and accuracy. Next, the engine cover 2 is pressed downwardly, so that the head portion 41 of the portion to be mounted 4 is inserted into the interior of the large diameter hole portion 71. When the head portion 41 passes through the large diameter hole portion 71, enters the small diameter hole portion 72 and passes through the small diameter hole portion 72, the press fit of the portion to be mounted 4 is stopped at a position where end portions of the ribs 45 are brought into abutment with a surface of the positioning end 75 of the elastic member 7, whereby the mounting portion 5 is fixed to the portion to be mounted 4. Since the outside diameter W1 of the head portion 41 is larger than the inside diameter W2 of the small diameter hole portion 72, the small diameter hole portion 72 is diametrically expanded temporarily when the head portion 41 is passed therethrough, and when the head portion 41 has passed therethrough, the small diameter hole portion 72 elastically deforms again and restores its inside diameter down to one equal to the outside diameter W4 of the leg portion 40. Due to this, the head portion 41, which has once passed through the small diameter hole portion 72, is made difficult to be reversed, whereby the portion to be mounted 4 is fixed to the elastic member 7. The portion to be mounted 4 is fixed to the elastic member 7, and the mounting portion 5 and the portion to be mounted 4 are fixed to each other, whereby the engine cover 2 is held on the engine member 1.

In the engine cover mounting structure of the embodiment, the relationship between the outside diameter W1 of the head portion 41 and the inside diameter W2 of the small diameter hole portion 71 is W1>W2, and the relationship between the inside diameter W3 of the large diameter hole portion 71 and the outside diameter W4 of the leg portion 40 is W3≧W4. Due to this, a press fit load at an initial stage of insertion is small, a press fit load at a middle stage of insertion is large, and a press fit load at a last stage of insertion becomes small. Consequently, a superior click stop feeling in insertion can be obtained, whereby the mounting work efficiency of the engine cover 2 and the engine member is increased.

Since the large diameter hole portion 71 and the small diameter hole portion 72 communicate with each other in the step-like fashion and the axial length of the small diameter hole portion 72 is made shorter than the axial length of the large diameter hole portion 71, when the head portion 40 passes through the large diameter hole portion 71 to each the small diameter hole portion 72, the press fit load increases and decreases largely in a small displacement. Consequently, with the drastic fluctuation in press fit load, an extremely superior click stop feeling in insertion can be obtained.

Furthermore, since the portion to be restrained 70 is provided on the outer circumferential side of the large diameter hole portion 71 (the outer circumferential portion of the non-tightening portion 73), an outer circumferential side of the small diameter hole portion 72 of the elastic member 7 (an outer circumferential portion of the tightening portion 74) is not retrained by the restraining portion 63. Consequently, the tightening portion 74 is easy to be deformed, and hence, the press fit load become excessive in no case. Due to this, the mounting work efficiency of the engine cover 2 on the engine member 1 is increased further.

Figure 5:
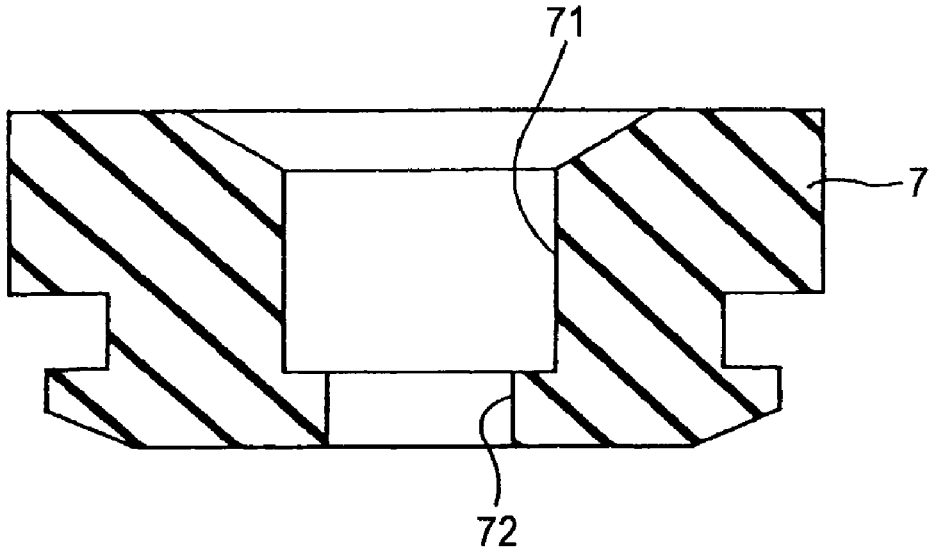
FIG. 5 is a sectional view which exemplarily represents another elastic member of the engine cover mounting structure of the invention.

Note that while a boundary portion between the large diameter hole portion 72 and the small diameter hole portion 71 is made into a slope or bevel in this embodiment, the inside diameter of the large diameter hole portion 71 may be formed even in the axial direction as shown in FIG. 5, for example. In this case, the press fit load increases further drastically which results when the head portion 41 passes through the large diameter hole portion 71 to reach the small diameter hole portion 71, whereby the click stop feeling in insertion is increased further.

Embodiment 2

Figure 6:
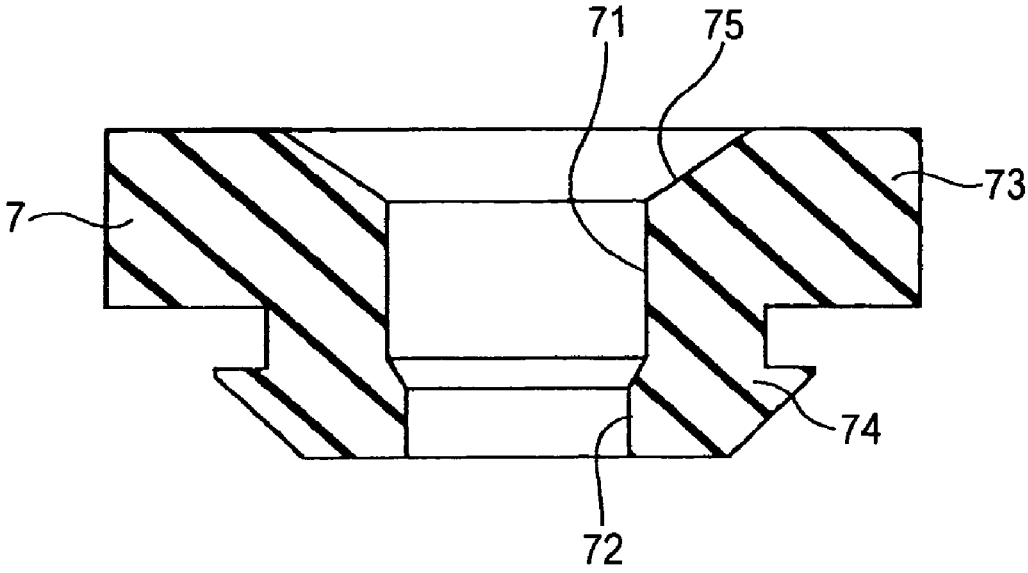
FIG. 6 is a sectional view which exemplarily shows an elastic member of the engine cover mounting structure of Embodiment 2.

An engine mounting structure of Embodiment 2 is similar to that of Embodiment 1 except for an inside diameter W2 of a small diameter hole portion 72. FIG. 6 is a sectional view which exemplarily shows an elastic member 7 of the engine mounting structure of the embodiment.

In the engine cover mounting structure of Embodiment 2, the inside diameter W2 of the small diameter hole portion 72 is made larger than that of Embodiment 1. An axial length H1 of a tightening portion 74, an axial length H2 of a non-tightening portion 73 and an inside diameter W3 of a large diameter hole portion 71 are the same as those of Embodiment 1.

Also in the engine cover mounting structure of Embodiment 2, relationships of W1>W2 and W3≧W4 are established, and a portion to be restrained 70 is provided on an outer circumferential side of the large diameter hole portion 71. Due to this, the engine cover mounting structure of Embodiment 2 is also superior in mounting work efficiency as with Embodiment 1.

Note that in the engine cover mounting structure of Embodiment 2, the inside diameter W2 of the small diameter hole portion 72 is 11 mm, and the inside diameter W3 of the large diameter hole portion 71 is 13 mm. Furthermore, the axial length H1 of the tightening portion 74 is 5 mm, and the axial length H2 of the non-tightening portion 73 is 14 mm. The axial length H3 of the non-tightening portion 73 excluding a positioning end 75 is 9 mm.

Embodiment 3

Figure 7:
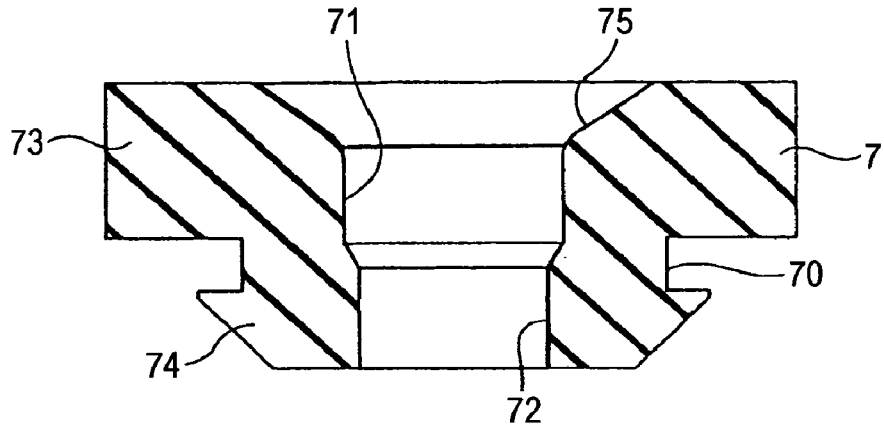
FIG. 7 is a sectional view which exemplarily shows an elastic member of the engine cover mounting structure of Embodiment 3.

An engine cover mounting structure of Embodiment 3 is identical to that of Embodiment 1 except for an axial length H1 of a tightening portion 74 and an axial length H2 of a non-tightening portion 73. FIG. 7 is a sectional view which shows exemplarily an elastic member 7 of the engine cover mounting structure of the embodiment.

In the engine cover mounting structure of Embodiment 3, the axial length H1 of the tightening portion 74 is set larger than that of Embodiment 1, and the axial length H2 of the non-tightening portion 73 is set smaller than that of Embodiment 1. An inside diameter W2 of a small diameter hole portion 72 and an inside diameter W3 of a large diameter hole portion 71 are the same as those of Embodiment 1. In addition, in this embodiment, since the length ratio of H1 and H2 is changed, a portion to be restrained 70 is provided part of an outer circumferential side of the small diameter hole portion 72 in addition to an outer circumferential side of the large diameter hole portion 71.

Also, in the engine cover mounting structure of Embodiment 3, relationships of W1>W2 and W3≧W4 are established. Due to this, the engine cover mounting structure of this embodiment is also superior in mounting work efficiency as with Embodiment 1.

Note that in the engine cover mounting structure of Embodiment 3, the inside diameter W2 of the small diameter hole portion 72 is 10 mm, and the inside diameter W3 of the large diameter hole portion 71 is 13 mm. Furthermore, the axial length H1 of the tightening portion 74 is 7 mm, and the axial length H2 of the non-tightening portion 73 is 12 mm. The axial length H3 of the non-tightening portion 73 excluding a positioning end 75 is 7 mm.

COMPARISON EXAMPLE 1

Figure 8:
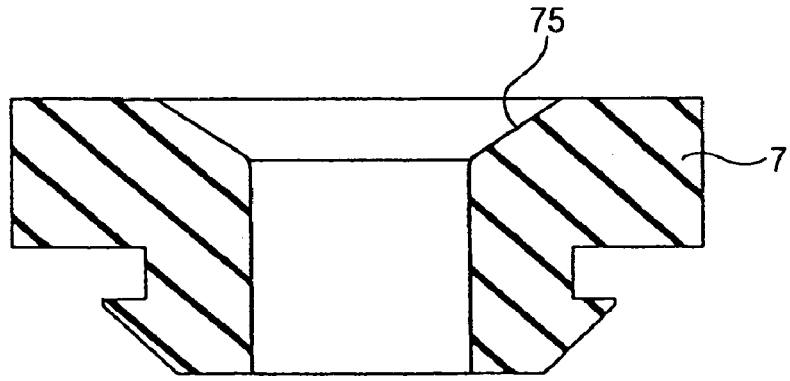
FIG. 8 is a sectional view which exemplarily shows an elastic member of the engine cover mounting structure of Comparison Example 1.

An engine cover mounting structure of Comparison Example 1 is identical to that of Embodiment 1 except for the shape of an elastic member 7. FIG. 8 is a sectional view which shows exemplarily the elastic member 7 of the engine cover mounting structure of this comparison example.

In the engine cover mounting structure of Embodiment 1, similar to Embodiment 1, a positioning end 75 is formed on an elastic member 7, but the elastic member 7 is formed to have the same diameters at the other portions in the axial direction.

In the engine cover mounting structure of the comparison example, an inside diameter of the elastic member 7 is 12 mm, and an axial length H4 of a portion of the elastic member 7 which excludes a positioning end 75 is 14 mm.

COMPARISON EXAMPLE 2

An engine cover mounting structure of Comparison Example 2 is identical to that of Comparison Example 1 except for an inside diameter of an elastic member 7. In the engine cover mounting of Comparison 2, the inside diameter of the elastic member 7 is 11.5 mm, and an axial length H4 of a portion of the elastic member 7 which excludes a positioning end 75 is 14 mm.

COMPARISON EXAMPLE 3

An engine cover mounting structure of Comparison Example 3 is identical to that of Comparison Example 1 except for an inside diameter of an elastic member 7. In the engine cover mounting of Comparison 3, the inside diameter of the elastic member 7 is 11 mm, and an axial length H4 of a portion of the elastic member 7 which excludes a positioning end 75 is 14 mm.

(Load Test 1)

As to the engine cover mounting structures of Embodiments 1 to 3 and Comparison Examples 1 to 3, the magnitude of a press fit load acting on the portion to be mounted 4 when the engine cover 2 is mounted on the engine member 1 was investigated. An Amsler testing machine was used to measure press fit loads. Note that a push-pull gauge may be used instead. In addition, an ABAQUS was used for analysis.

As to the engine cover mounting structures of the respective embodiments and respective comparison examples, a relationship between a displacement of the head portion 41 (a distance over which the head portion 41 is inserted into the elastic member 7) and a press fit load when the load is applied to the engine cover 2 gradually in the state that the head portion 41 is in abutment with the positioning end 75 was operated.

Figure 9:
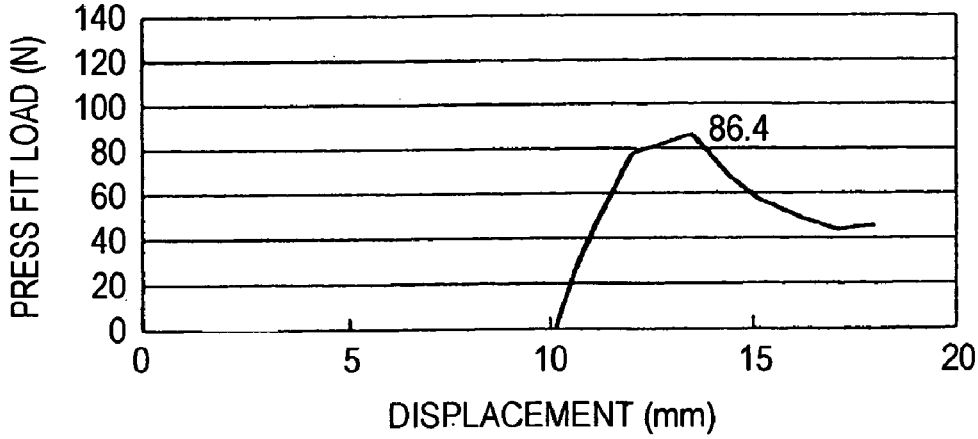
FIG. 9 is a graph representing a transition of a press fit load in the engine cover mounting structure of Embodiment
Figure 10:
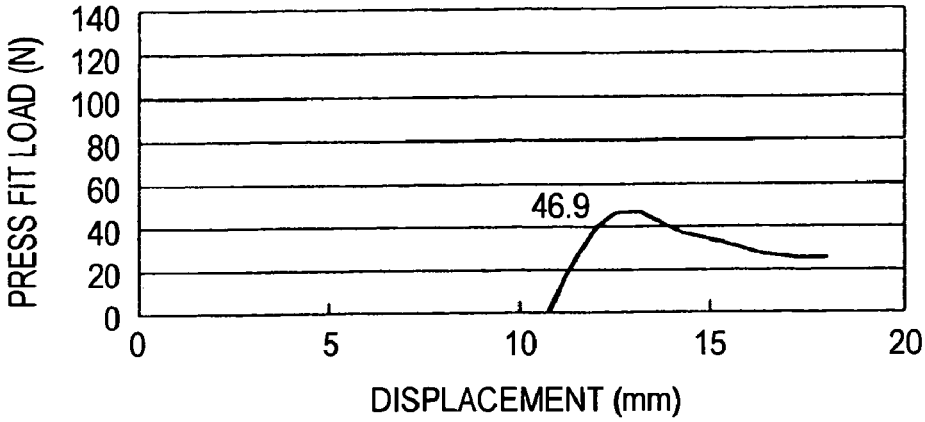
FIG. 10 is a graph representing a transition of a press fit load in the engine cover mounting structure of Embodiment 2.
Figure 11:
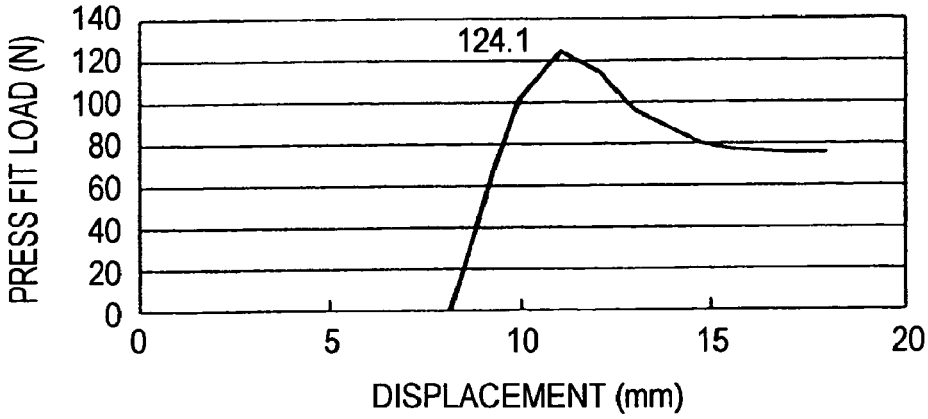
FIG. 11 is a graph representing a transition of a press fit load in the engine cover mounting structure of Embodiment 3.
Figure 12:
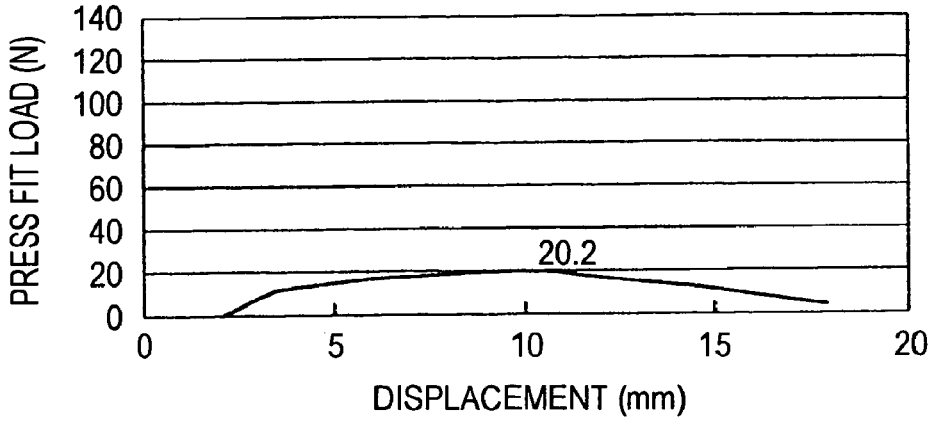
FIG. 12 is a graph representing a transition of a press fit load in the engine cover mounting structure of Comparison Example 1.
Figure 13:
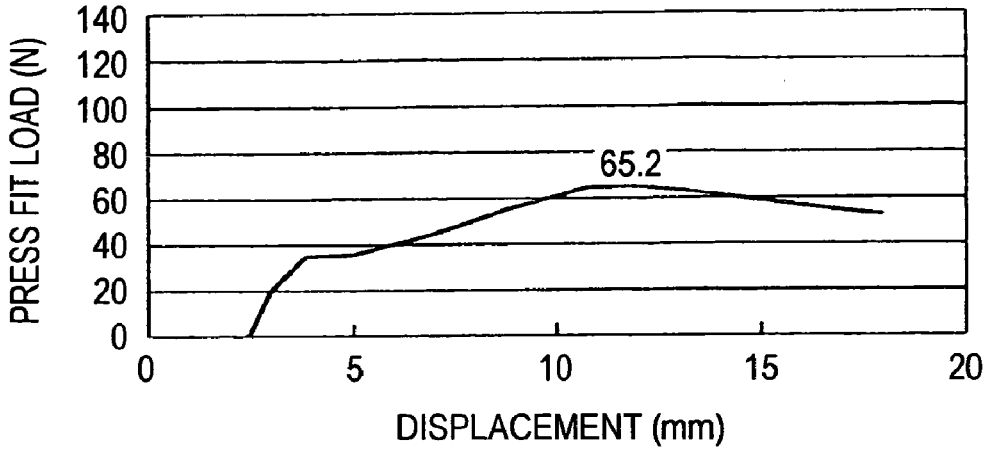
FIG. 13 is a graph representing a transition of a press fit load in the engine cover mounting structure of Comparison Example 2.
Figure 14:
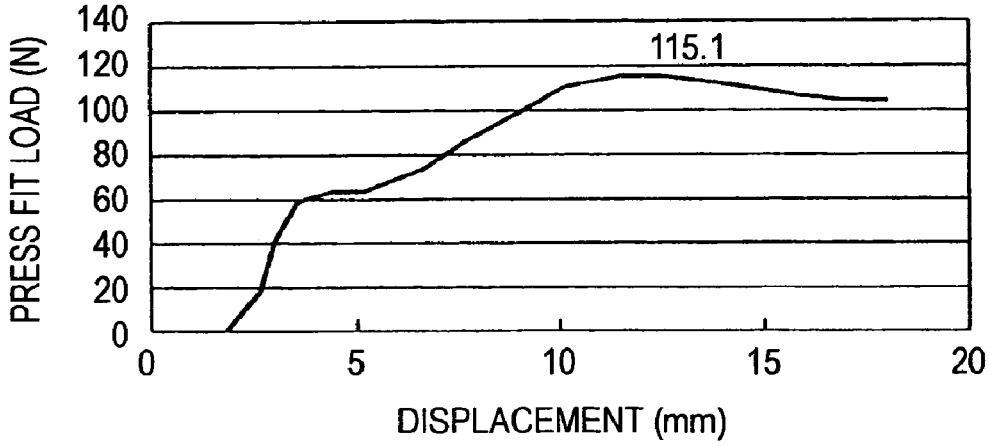
FIG. 14 is a graph representing a transition of a press fit load in the engine cover mounting structure of Comparison Example 3.

FIG. 9 shows a graph representing a transition of a press fit load in the engine cover mounting structure of Embodiment 1. FIG. 10 shows a graph representing a transition of a press fit load in the engine cover mounting structure of Embodiment 2. FIG. 11 shows a graph representing a transition of a press fit load in the engine cover mounting structure of Embodiment 3. FIG. 12 shows a graph representing a transition of a press fit load in the engine cover mounting structure of Comparison Example 1. FIG. 13 shows a graph representing a transition of a press fit load in the engine cover mounting structure of Comparison Example 2. FIG. 14 shows a graph representing a transition of a press fit load in the engine cover mounting structure of Comparison Example 3. In FIGS. 9 to 14, the axis of ordinates denotes press fit load (N), and the axis of abscissas denotes length over which the head portion 41 was inserted into the elastic member 7, that is, displacement (mm) of the head portion 41 from the position where the head portion 41 was brought into abutment with the positioning end 75.

As shown in FIGS. 9 to 11, in the engine cover mounting structures of Embodiments 1 to 3, the press fit load is 0 at the initial stage of insertion (this is when the head portion 41 is considered to be disposed in the large diameter hole portion 71 from the displacement of the head portion 41, and in FIG. 9, the displacement of the head portion 41 is 10 mm or less). Then, the press fit load drastically increases at the middle stage of insertion (this is when the head portion 41 is considered to be disposed in the small diameter hole portion 72 from the displacement of the head portion 41, in FIG. 9, the displacement of the head portion 41 is in the vicinity of 10 to 14 mm), and the press fit load drastically falls at the last stage of insertion (this is when the head portion 41 is considered to have passed through the small diameter hole portion 72 from the displacement of the head portion 41, and in FIG. 9, the displacement of the head portion 41 is 14 mm or larger). It is seen from these results that the engine cover mounting structures of the respective embodiments are extremely superior in click stop feeling in insertion.

On the other hand, as shown in FIGS. 12 to 14, in the engine cover mounting structures of Comparison Examples 1 to 3, the press fit load increases moderately and decreases moderately. It is seen from these results that the engine cover mounting structures of the respective comparison examples are inferior in click stop feeling in insertion.

It is considered that this is because in the engine cover mounting structures of the embodiments, the large diameter hole portion 71 and the small diameter hole portion 72 are provided, whereby the portion having the small inside diameter and the portion having the large inside diameter are formed, whereas in the engine cover mounting structures of the comparison examples, there are provided no such large diameter hole portion 71 and small diameter hole portion 72 and hence the inside diameter of the elastic member 7 is formed constant. Namely, in the engine mounting structures of the embodiments, the inside diameter of the elastic member 7 changes drastically at the boundary portion between the large diameter hole portion 71 and the small diameter hole portion 72. Since the press fit load acting on the portion to be mounted 4 remains small in such a state that the head portion 41 is disposed in the large diameter hole portion 71 and the press fit load acting on the head portion 41 increases when the head portion 41 is disposed in the small diameter hole portion 72, the press fit load acting on the portion to be mounted 4 drastically increases even in the event that the displacement of the head portion 41 between the large diameter hole portion 72 and the small diameter hole portion 71 is small. Furthermore, the press fit load drastically decreases when the head portion 41 projects out of the end portion of the small diameter hole portion 72. By virtue of this, it is considered that the superior click stop feeling in insertion can be obtained in the engine cover mounting structures of the embodiments. On the other hand, in the engine cover mounting structures of the comparison examples, since the inside diameter of the elastic member 7 is constant, the press fit load acting on the head portion 41 does not change largely, and hence, it is considered that the relevant structures are inferior with respect to the click stop feeling in insertion. Furthermore, in the engine cover mounting structures of the comparison examples, since the inside diameter of the elastic member 7 is smaller than the outside diameter of the leg portion 40, an area where the portion to be mounted 4 comes into area contact with the elastic member 7 when the former is inserted into the latter becomes large. Due to this, it is considered that a large insertion load remains acting on the portion to be mounted 4 even at the last stage of insertion, whereby the click stop feeling in insertion is deteriorated.

In order to increase the click stop feeling in insertion, it is effective to change the inside diameter of the elastic member 7 drastically and largely. This is clear from the fact that in the engine mounting structure of Embodiment 1 in which the inside diameter of the small diameter hole portion 72 is smaller than that of Embodiment 2, the variation in press fit load relative to the displacement of the head portion 41 is larger than that of Embodiment 2, thus improving the click stop feeling in insertion. In addition, it is also effective to design such that the fluctuation in press fit load occurs in a small displacement by reducing the axial length of the small diameter hole portion.

In addition, in order to increase further the mounting work efficiency by reducing further the press fit load at the middle and last stages of insertion while maintaining the superior click stop feeling in insertion, it is effective that the portion to be restrained 70 does not overlap the small diameter hole portion 72 in the axial direction. In the engine cover mounting structure of Embodiment 1 in which the axial length and hence displacement of the small diameter hole portion 72 is smaller than that of Embodiment 3, while the press fit load at the middle and last stages of insertion is smaller that of Embodiment 3, the change in press fit load occurs almost as drastically as Embodiment 3. Note that in the engine cover mounting structure of Embodiment 3, the restraining portion 63 is also formed on the outer circumferential side of the small diameter hole portion 72. This functions to increase the press fit load at the middle and last stages of insertion.

(Load Test 2)

The engine cover mounting structure of Embodiment 2 and the engine cover mounting structure of Comparison Example 1 were compared with each other with respect to dislodgement load (a load required to dislodge the portion to be mounted 4, which is mounted on the mounting portion 5, from the mounting portion 5). Dislodgement loads were measured using the Amsler testing machine. Note that a push-pull gauge can be used instead. As a result, while dislodgement loads of 20 to 30N were measured in the engine cover mounting structure of Comparison Example 1, dislodgement loads of 60 to 70N were measured in the engine cover mounting structure of Embodiment 2. This is because since the hole diameter (the inside diameter of the small diameter hole portion 72) of the elastic member 7 in the engine cover mounting structure of Embodiment 2 is smaller than that of Comparison Example 1, the portion to be mounted 4 is made difficult to be dislodged once mounted. The difference in dislodgement load between the two engine cover mounting structures is also attributed to the fact that since the press fit load in the mounted state (at the last stage of insertion) is small in the engine cover mounting structure of Embodiment 2, a large load needs to be applied again in order to dislodge the portion to be mounted 4 that is now mounted on the mounting portion 5. In the engine cover mounting structure of Embodiment 2 in which the dislodgement load is large, there is provided an advantage that the engine cover 2 is mounted on the engine member 1 in a stable fashion.

What is claimed is:

1. An engine cover mounting structure comprising:

an engine member having a frame, which projects from the engine member, wherein the frame has a proximal portion, which is fixed to the engine member, and a distal portion which is spaced apart from the engine member;

an engine cover having an elongated coupling member that is integrally formed with the engine cover, and an elastic member, wherein the elastic member and the elongated coupling member form a separable coupling, the elastic member has a first end, which faces away from the engine member, and a second end, which faces toward the engine member, the elastic member is inserted in the distal portion of the frame so that the second end of the elastic member is spaced apart from and prevented from contacting the engine member by the proximal portion of the frame, the elongated coupling member comprises a distal portion and a proximal portion, and the proximal portion includes a leg portion and the distal portion includes a head portion, the proximal portion is joined to an inner surface of the engine cover, the head portion is formed at the distal portion of the elongated coupling member, the leg portion is located between the head portion and the inner surface of the engine cover, the head portion has a larger diameter than that of the leg portion, the head portion is spaced apart from the inner surface of the engine cover by the proximal portion of the elongated coupling member, the frame includes an end opening and a restraining portion, the elastic member further comprises:

a large diameter hole portion, which opens at the first end of the elastic member;

a small diameter hole portion, which opens at the second end of the elastic member, and the small diameter hole portion has a smaller inside diameter than an inside diameter of the large diameter hole portion; and an engagement recess, which receives the restraining portion to retain the elastic member at the distal portion of the frame, a distal end portion of the elongated coupling member is adapted to be inserted into the large diameter hole portion from the first end of the elastic member towards the small diameter hole portion, so that the head portion passes through the large diameter hole portion and the small diameter hole portion and extends outside of the elastic member from the second end of the elastic member, and the distal portion of the elongated member is held by the elastic member to couple the engine cover to the frame, a relationship between an outside diameter W1 of the head portion and the inside diameter W2 of the small diameter hole portion is expressed as W1>W2, and a relationship between the inside diameter W3 of the large diameter hole portion and an outside diameter W4 of the leg portion is expressed as W3≧W4, and the large diameter hole portion and the small diameter hole portion communicate with each other.

2. The engine cover mounting structure according to claim 1, wherein the engagement recess is provided at a position excluding an end portion of the small diameter hole portion lying opposite to the large diameter hole portion.

3. The engine cover mounting structure according to claim 1, wherein an axial length of the small diameter hole portion is shorter than an axial length of the large diameter hole portion.

4. The engine cover mounting structure according to claim 1, wherein the engagement recess lies adjacent to the small diameter hole portion with respect to an axial positional relationship.

5. The engine cover mounting structure according to claim 3, wherein the whole of the engagement recess is provided on the outer circumferential side of the large diameter hole portion.

6. The engine cover mounting structure according to claim 1, wherein the engagement recess does not overlap the small diameter hole portion in the axial direction.

7. The engine cover mounting structure according to claim 1, wherein a relationship between the outside diameter W1 of the head portion and the inside diameter W3 of the large diameter hole portion is W1≦W3.

8. The engine cover mounting structure according to claim 1, wherein an axial length of the small diameter hole portion is shorter than an axial length of the large diameter hole portion.

9. The engine cover mounting structure according to claim 1, wherein a relationship between an axial length H1 of the small diameter hole portion and an axial length H3 of the large diameter hole portion excluding the positioning end is expressed as H1≦H3.

10. The engine cover mounting structure according to claim 1, wherein the leg portion includes a rib that is in contact with the elastic member to position the mounting portion and the portion to be mounted with respect to each other.

11. An engine cover mounting structure comprising:

an engine member having a frame, wherein the frame includes a proximal portion, which is fixed to the engine member, and a distal portion, which is spaced apart from the engine member by the proximal portion of the frame;

an engine cover, which is adapted to be attached to the distal portion of the frame to cover the engine member;

an elongated projection that is integrally formed with the engine cover, wherein a proximal portion of the elongated projection is joined to an inner surface of the engine cover, and a distal portion of the elongated projection is spaced apart from the inner surface of the engine cover, and an elastic member, which is adapted to fit between the frame and the elongated projection when the engine cover is attached to the frame, so that the engine cover is supported by the elastic member and separated from the frame and the engine member by the elastic member, wherein the elastic member has a first end and a second end, which are opposite to one another, and the first end faces away from the engine member and the second end faces the engine member, the proximal portion of the elongated projection includes a leg portion, and a distal portion of the elongated projection includes a head portion, so that the head portion is spaced apart from the inner surface of the engine cover by the proximal portion of the elongated projection, the head portion is larger in diameter than the leg portion, the distal portion of the frame includes an end opening and a restraining portion, in which the end opening is defined, the elastic member is retained by the restraining portion so that the second end of the elastic member is spaced apart and is prevented from contacting the engine member, the elastic member includes a hole, which has a large diameter section, which opens at the first end of the elastic member, and a small diameter section, which opens at the second end of the elastic member, the elastic member includes an engagement portion, which is received by the end opening so that the engagement portion is held by the restraining portion, the small diameter section has a smaller inside diameter than an inside diameter of the large diameter section;

the large diameter section and the small diameter section are coaxial, the elastic member is located and arranged to receive the elongated projection first in the large diameter section and subsequently by the small diameter section, so that the head portion of the elongated projection extends from the second end of the elastic member outside of the small-diameter hole, and the proximal end of the elongated projection is spaced apart from the elastic member in an axial direction of the elongated member after the elongated projection is fully received by the elastic member, and a relationship between an outside diameter W1 of the head portion and the inside diameter W2 of the small diameter section is expressed as W1>W2, and a relationship between the inside diameter W3 of the large diameter section and an outside diameter W4 of the leg portion is expressed as W3≧W4.

12. The engine cover mounting structure according to claim 11, wherein the elastic member is constructed and arranged on the frame to prevent the elongated projection from directly contacting the engine member or the frame.

* * * * *